US008366227B2

(12) United States Patent
Ogura

(10) Patent No.: US 8,366,227 B2
(45) Date of Patent: Feb. 5, 2013

(54) PRESSURE DAMPER, LIQUID JET HEAD, LIQUID JET APPARATUS, AND PRESSURE DAMPING METHOD

(75) Inventor: Tatsuya Ogura, Chiba (JP)

(73) Assignee: SII Printek Inc. (JP)

( * ) Notice: Subject to any disclaimer, the term of this patent is extended or adjusted under 35 U.S.C. 154(b) by 0 days.

(21) Appl. No.: 12/931,946

(22) Filed: Feb. 15, 2011

(65) Prior Publication Data

US 2011/0234678 A1 Sep. 29, 2011

(30) Foreign Application Priority Data

Feb. 25, 2010 (JP) ..... 2010-041059

(51) Int. Cl.
*B41J 29/38* (2006.01)

(52) U.S. Cl. ..... 347/14

(58) Field of Classification Search ..... 347/14
See application file for complete search history.

(56) References Cited

U.S. PATENT DOCUMENTS

| | | | | |
|---|---|---|---|---|
| 5,992,990 | A | 11/1999 | Childers et al. | 347/87 |
| 2003/0067520 | A1* | 4/2003 | Inoue et al. | 347/86 |
| 2006/0007254 | A1* | 1/2006 | Tanno et al. | 347/7 |
| 2007/0188529 | A1 | 8/2007 | Zhang | 347/7 |
| 2008/0198207 | A1 | 8/2008 | Katada | 347/85 |
| 2009/0174734 | A1 | 7/2009 | Wanibe | 347/7 |
| 2009/0179974 | A1* | 7/2009 | Kimura | 347/85 |

FOREIGN PATENT DOCUMENTS

| | | |
|---|---|---|
| EP | 2050572 | 4/2009 |
| WO | 98 55322 | 12/1998 |

OTHER PUBLICATIONS

Patent Abstracts of Japan, publication No. 05-201015, publication date Aug. 10, 1993.

* cited by examiner

*Primary Examiner* — Laura Martin
(74) *Attorney, Agent, or Firm* — Adams & Wilks

(57) ABSTRACT

A pressure damper includes a recess portion for storing liquid, and a flexible film that covers an opening of the recess portion. A liquid inflow port and a liquid outflow port communicate with the recess portion. A pressure detecting portion detects a pressure value of the liquid flowing out from the liquid outflow port, and a control circuit portion outputs a drive signal based on the pressure value of the pressure detecting portion. A pressure adjusting portion adjusts the pressure in the recess portion by forcibly deforming the flexible film based on the drive signal output from the control circuit portion. The pressure damper reliably suppresses change in the discharge amount of ink due to pressure fluctuation.

12 Claims, 7 Drawing Sheets

PRESSURE DAMPER, LIQUID JET HEAD, LIQUID JET APPARATUS, AND PRESSURE DAMPING METHOD

In this case, by the movement of the carriage, the ink supply tube pulsates and ink inside the ink supply tube moves, and thus pressure fluctuation is generated. This pressure fluctuation is applied to the liquid jet head through the ink supply tube. As a result, change in discharge droplet amount (drop volume) of the ink occurs, and hence the quality of the image and the characters recorded on the recording medium are deteriorated.

BACKGROUND OF THE INVENTION

1. Field of the Invention

The present invention relates to a pressure damper for damping unnecessary vibrations in liquid, and a liquid jet head including the pressure damper.

2. Description of the Related Art

In these days, there are provided many ink jet type recording apparatuses which perform recording of an image or a character by discharging ink droplets on a recording medium such as a recording sheet. In a recording apparatus of this type, ink is supplied from an ink tank or an ink cartridge to a liquid jet head, which is mounted on a carriage, via an ink supply tube. Ink droplets are discharged on the recording medium from nozzles of the liquid jet head while the carriage is caused to move in a main scan direction. At the same time, the recording medium is caused to move in a sub scan direction. In this manner, the recording is performed on the recording medium.

In this case, by the movement of the carriage, the ink supply tube pulsates and ink inside the ink supply tube moves, and thus pressure fluctuation is generated. This pressure fluctuation is applied to the liquid jet head through the ink supply tube. As a result, change in discharge droplet amount (drop volume) of the ink occurs, and hence quality of the image and the character recorded on the recording medium is deteriorated.

Therefore, in order to alleviate unnecessary pressure fluctuation applied to the liquid jet head, there is proposed a technology of alleviating the pressure fluctuation by providing a pressure damper in the middle of the ink supply tube. The pressure damper has a cavity in which ink is storable to some extent, and the pressure fluctuation of the ink is alleviated by causing the ink flowing out from the ink supply tube to flow into the cavity (for example, see JP 05-201015 A).

However, when the unnecessary pressure fluctuation applied to the liquid jet head is large, the capacity of the pressure damper is also required to be large. In particular, in a case of a large-sized liquid jet apparatus, a long ink supply tube is provided, and hence larger pulsation occurs in the ink supply tube when the carriage moves. Further, in order to obtain an effect similar to that provided by the pressure damper, it is conceivable to provide a sub-tank between the liquid jet head and an ink storing tank or an ink cartridge. However, in this case, there is a problem in that the liquid jet apparatus becomes large in size.

SUMMARY OF THE INVENTION

The present invention has been made in view of the above-mentioned circumstances, and therefore has an object to provide a pressure damper capable of effectively suppressing unnecessary pressure fluctuation of liquid without increasing a size of a liquid jet apparatus, and a method for performing the suppressing.

In order to solve the above-mentioned problems, a first aspect of a pressure damper according to the present invention includes: a main body portion including a recess portion for storing liquid; a flexible film provided on the main body portion so as to cover the recess portion; a pressure damping portion including a liquid inflow port and a liquid outflow port which are communicated to the recess portion; a pressure detecting portion for detecting a pressure value of the liquid flowing out from the liquid outflow port; a control circuit for outputting a control signal based on the pressure value output from the pressure detecting portion; and a pressure adjusting portion for adjusting pressure in the recess portion by deforming the flexible film based on the control signal output from the control circuit.

According to a second aspect of the pressure damper of the present invention, in the first aspect thereof, the pressure adjusting portion includes two paired elements which are controllable based on the control signal, the two paired elements include one element which is engaged with the flexible film, and the two paired elements generate one of attraction force and repulsive force therebetween.

According to a third aspect of the pressure damper of the present invention, in the second aspect thereof, the pressure damper further includes a suppression plate which is engaged with the main body portion and covers the flexible film.

According to a fourth aspect of the pressure damper of the present invention, in the third aspect thereof, the one element of the two paired elements is engaged with the flexible film, and another element of the two paired elements is engaged with the suppression plate.

According to a fifth aspect of the pressure damper of the present invention, in the fourth aspect thereof, the one element and the another element are engaged with a surface of the flexible film and a surface of the suppression plate on the flexible film side; respectively, so that the two paired elements are opposed to each other.

According to a sixth aspect of the pressure damper of the present invention, in the third to fifth aspects thereof, the control circuit is disposed between the flexible film and the suppression plate.

According to a seventh aspect of the pressure damper of the present invention, in the second to sixth aspects thereof, one element of the two paired elements includes a coil portion, and another element of the two paired elements includes a magnetic body portion.

According to an eighth aspect of the pressure damper of the present invention, in the second to sixth aspects thereof, one element of the two paired elements includes a first coil portion, and another element of the two paired elements includes a second coil portion.

According to a ninth aspect of the pressure damper of the present invention, in the first to eighth aspects thereof, the pressure damper further includes a bias member, which is elastically deformable, between the recess portion and the flexible film.

An aspect of a liquid jet head according to the present invention includes: the pressure damper described in the first to ninth aspects; and a plurality of nozzles for jetting liquid supplied from the liquid outflow port.

An aspect of a liquid jet apparatus according to the present invention includes: the liquid jet head described above; a moving mechanism for reciprocating the liquid jet head in a manner that the liquid jet head is opposed to a recording medium; and a transfer mechanism for transferring the recording medium.

An aspect of a pressure damping method for a pressure damper according to the present invention, the pressure damper including: a main body portion including a recess portion for storing liquid; a flexible film provided on the main body portion so as to cover the recess portion; and a liquid inflow port and a liquid outflow port which are communicated to the recess portion, includes: detecting a pressure value of the liquid flowing out from the liquid outflow port to output the pressure value to a control circuit; and adjusting pressure in the recess portion by deforming the flexible film based on a control signal output from the control circuit based on the pressure value.

According to the present invention, by actively deforming the flexible film of the pressure damping portion based on the pressure value of the pressure detecting portion provided on the liquid outflow port of the pressure damping portion, it is possible to effectively cancel the ink pressure fluctuation. Specifically, when the pressure value of the pressure detecting portion is changed with respect to a reference value to indicate depressurization, the flexible film is deformed to the recess portion side, and when the pressure value thereof is changed to indicate pressurization, the flexible film is deformed to a side opposite to the recess portion. By deforming the flexible film as described above, even when unnecessary pressure is applied to the liquid inflow port, the pressure of the liquid outflow port can be maintained constant. Further, unlike the prior art, the pressure is controlled by actively deforming the flexible film, and hence it is unnecessary to increase capacity of the pressure damper or provide a sub-tank. Owing to those effects, even in the case of an apparatus structure in which a long ink supply-tube is provided and a large pressure fluctuation is applied to the ink, it is possible to avoid increasing the size of the pressure damper or the liquid jet apparatus.

DETAILED DESCRIPTION OF THE PREFERRED EMBODIMENTS

Next, embodiments of the present invention are described with reference to the drawings.

(First Embodiment)

Figure 1:
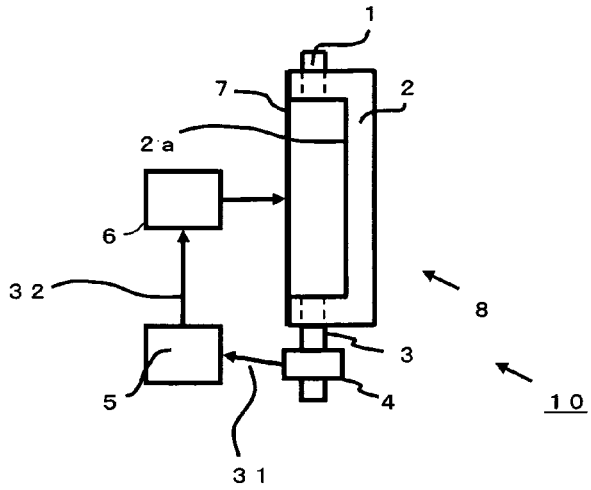
FIG. 1 is a basic structural diagram of a pressure damper according to an embodiment of the present invention.

FIG. 1 is a structural diagram of a pressure damper. Hereinafter, this embodiment is described with reference to the drawing. A pressure damper 10 includes a pressure damping portion 8, a pressure detecting portion 4, a control circuit portion 5, and a pressure adjusting portion 6. In a liquid jet apparatus, a liquid inflow port 1 of the pressure damping portion 8 is connected to a liquid supply tank (not shown), and a liquid outflow port 3 thereof is connected to a liquid jet head (not shown).

The pressure damping portion 8 includes a main body portion 2 including a recess portion 2*a* for storing liquid, a flexible film 7, and the liquid inflow port 1 and the liquid outflow port 3 which communicate to the recess portion 2*a*. Under this structure, the recess portion 2*a* of the main body portion 2 is covered with the flexible film 7, and thus space for storing liquid is provided.

The main body portion 2 is desired to be made of a material having resistance to liquid to be stored. For example, in a case where liquid such as water or chemical is used, there may be used a product formed of high-density polyethylene having good resistance to such liquid. Further, the flexible film 7 has flexibility, is made of a low-density polyethylene film which is suitable for bonding to the main body portion 2, and is fusion-bonded to a periphery edge portion of the main body portion 2 so as to cover the recess portion thereof.

The pressure detecting portion 4 is inserted between the main body portion 2 and the liquid jet head (see FIG. 7), and detects pressure applied to the liquid jet head. For example, as the pressure detecting portion 4, there is used a general diaphragm gauge type pressure sensor having a function of outputting an analog voltage. With this structure, a pressure value of liquid flowing out from the liquid outflow port 3 is detected.

Figure 2:
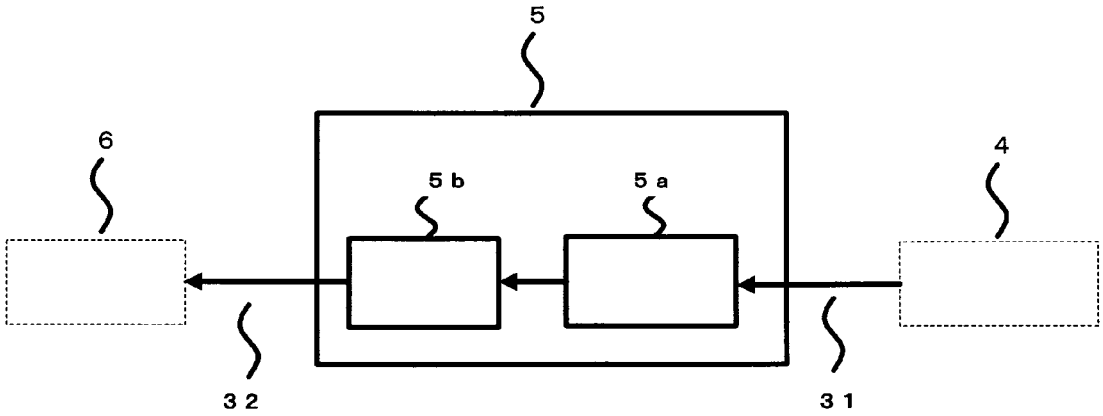
FIG. 2 is a block diagram of a control circuit portion according to the embodiment of the present invention.

FIG. 2 is a block diagram of the control circuit portion 5. The control circuit portion 5 includes an amplifier circuit 5*a* in a pre-stage, and a pressure adjusting portion drive circuit 5*b* in a later stage. An analog voltage 31 from the pressure detecting portion 4 is input to the amplifier circuit 5*a*, and a drive signal 32 for driving the pressure adjusting portion 6 is output from the pressure adjusting portion drive circuit 5*b*. For example, the pressure adjusting portion drive circuit 5*b* is a "voltage-current conversion circuit". With this structure, the drive signal 32 is generated based on the analog voltage 31 output from the pressure detecting portion 4.

Figure 3A:
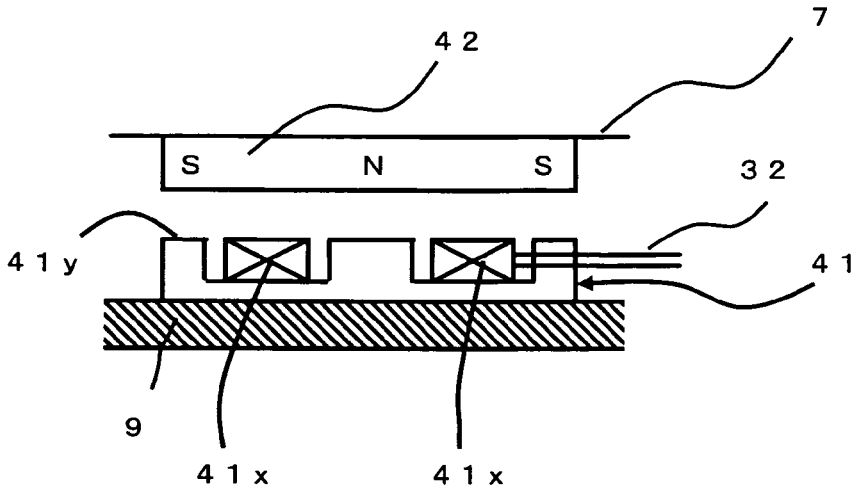
FIGS. 3A and 3B are diagrams illustrating a structure of a pressure adjusting portion according to the embodiment of the present invention.
Figure 3B:
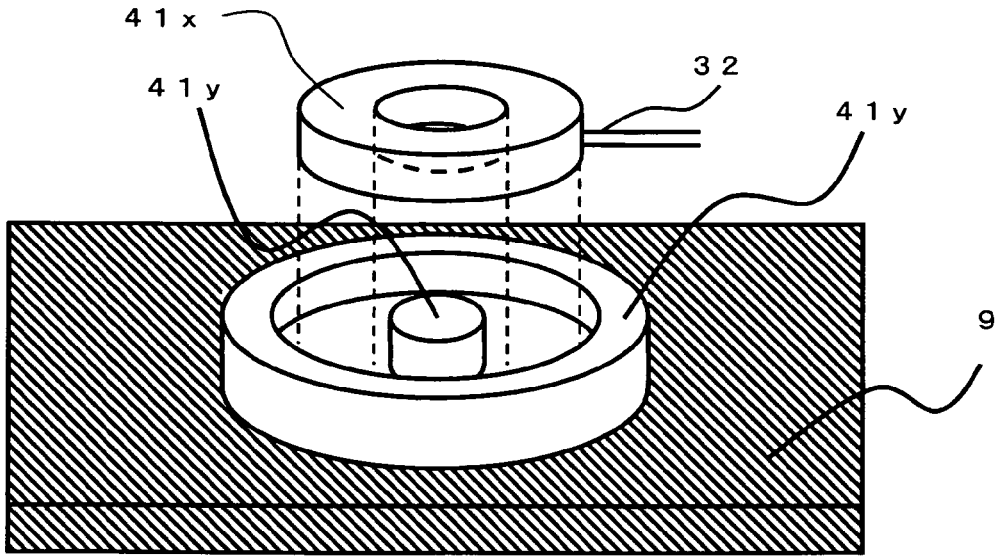

FIGS. 3A and 3B are diagrams illustrating a structure of the pressure adjusting portion 6. The pressure adjusting portion 6 includes two paired elements. Here, in the first embodiment, one of the two paired elements is a coil portion 41, and the other thereof is a magnetic body portion 42.

The coil portion 41 has a structure in which an air core coil 41*x* is fitted into a magnetic core 41*y* which has a pot core structure and is E-shaped in cross section. Further, the magnetic body portion 42 is a disc-like permanent magnet which is magnetized so that a center portion and an outer periphery portion thereof are polarized in different magnetic poles from each other. Further, the coil portion 41 and the magnetic body portion 42 are disposed so as to be opposed to each other with a predetermined gap provided therebetween. One of the coil portion 41 and the magnetic body portion 42 is engaged with the flexible film. For example, in FIG. 3A, the magnetic body portion 42 is engaged with the flexible film 7, and the coil portion 41 is engaged with a suppression plate 9. Further, the center portion and the outer periphery portion of the magnetic body portion 42 are polarized into the north pole and the south pole, respectively. With this structure, by changing a direction of a current caused to flow through the coil portion 41, it is possible to generate attraction force and repulsive force between the coil portion 41 and the magnetic body portion 42.

Figure 4:
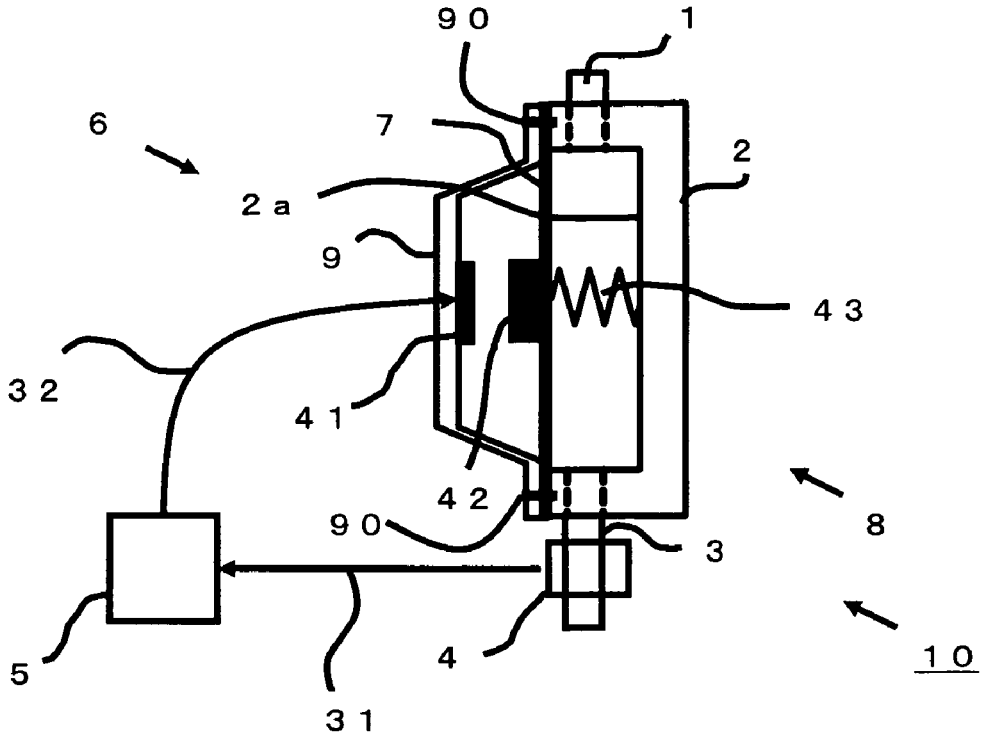
FIG. 4 is an explanatory diagram illustrating a specific structure of the pressure damper according to the embodiment of the present invention.

FIG. 4 is a diagram illustrating a specific structure of the pressure damper. Note that, in the structure illustrated in FIG. 4, the same components as those of the above-mentioned embodiment are denoted by the same reference symbols, and description of operation of the same component is omitted so as to avoid overlapping description. As described above, the pressure damper 10 includes the pressure damping portion 8, the pressure detecting portion 4, the control circuit portion 5, and the pressure adjusting portion 6. The suppression plate 9 is a galvanized steel plate in which a recess portion is formed at a center thereof by drawing. The suppression plate 9 is fixed to a periphery edge of the main body portion 2 by screws 90. In the pressure adjusting portion 6, the coil portion 41 is bonded on a bottom surface of the recess portion of the suppression plate 9, and the magnetic body portion 42 is bonded on the flexible film 7. Further, an elastically deformable bias member 43 is provided between the flexible film 7 and the recess portion 2*a*. With this, the flexible film 7 is given a reference position. The bias member 43 is a stainless-steel coil spring.

Figure 5A:
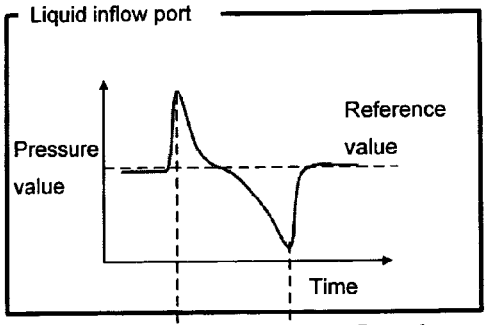
FIGS. 5A to 5E are explanatory diagrams illustrating an operating principle of a pressure damping action according to the embodiment of the present invention.
Figure 5B:
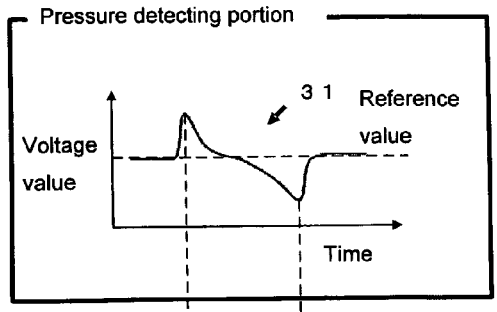
Figure 5C:
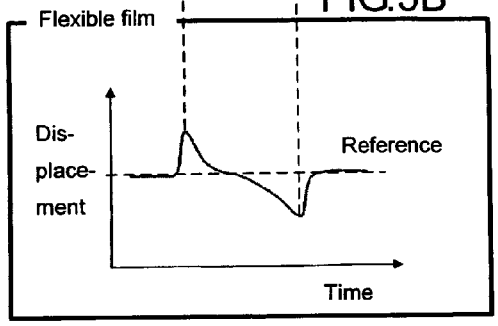

Next, an operating principle of a pressure damping action according to the present invention is described with reference to FIGS. 5A to 5E. Pressure applied to the liquid inflow port 1 as illustrated in FIG. 5A is detected as the analog voltage value 31 by the pressure detecting portion 4 as illustrated in FIG. 5B. Based on the analog voltage value 31, the control circuit portion 5 drives the coil portion 41, to thereby generate attraction force and repulsive force between the coil portion 41 and the magnetic body portion 42. Specifically, when the pressure detected by the pressure detecting portion 4 is changed to indicate pressurization, the flexible film 7 is forcibly deformed to the suppression plate side, and when the pressure detected therein is changed to indicate depressurization, the flexible film 7 forcibly is deformed to the recess portion side, as illustrated in FIG. 5C.

Figure 5D:
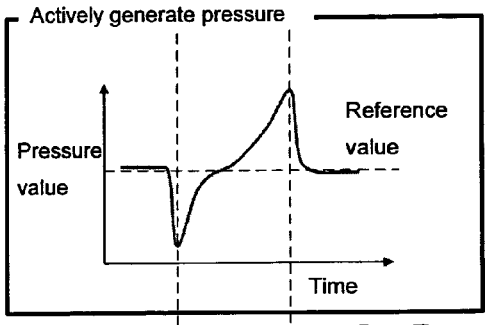
Figure 5E:
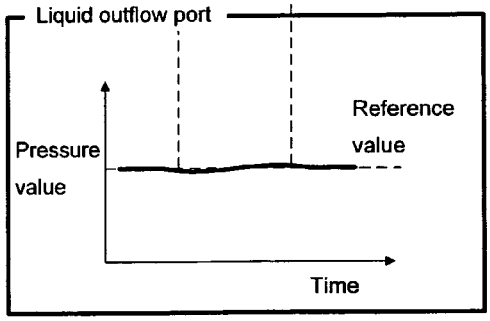

Based on the operating principle as described above, it is possible to actively generate pressure for pressurization or depressurization so as to cancel the applied unnecessary pressure (FIG. 5D). Therefore, even when unnecessary pressure is applied to the liquid inflow port 1, it is possible to effectively suppress the pressure fluctuation in the liquid outflow port 3 (FIG. 5E).

(Second Embodiment)

In the first embodiment, description is made of a structure in which the flexible film 7 is driven with use of the coil portion 41 and the magnetic body portion 42 as two paired elements which are controllable based on the drive signal 32. As a second embodiment, there may be provided a structure in which a second coil portion is provided in place of the magnetic body portion 42. That is, there may be provided a structure in which one of a first coil portion 41*a* and a second coil portion 41*b* is engaged with the flexible film 7, and the first coil portion 41*a* and the second coil portion 41*b* are arranged to be opposed to each other.

Figure 6:
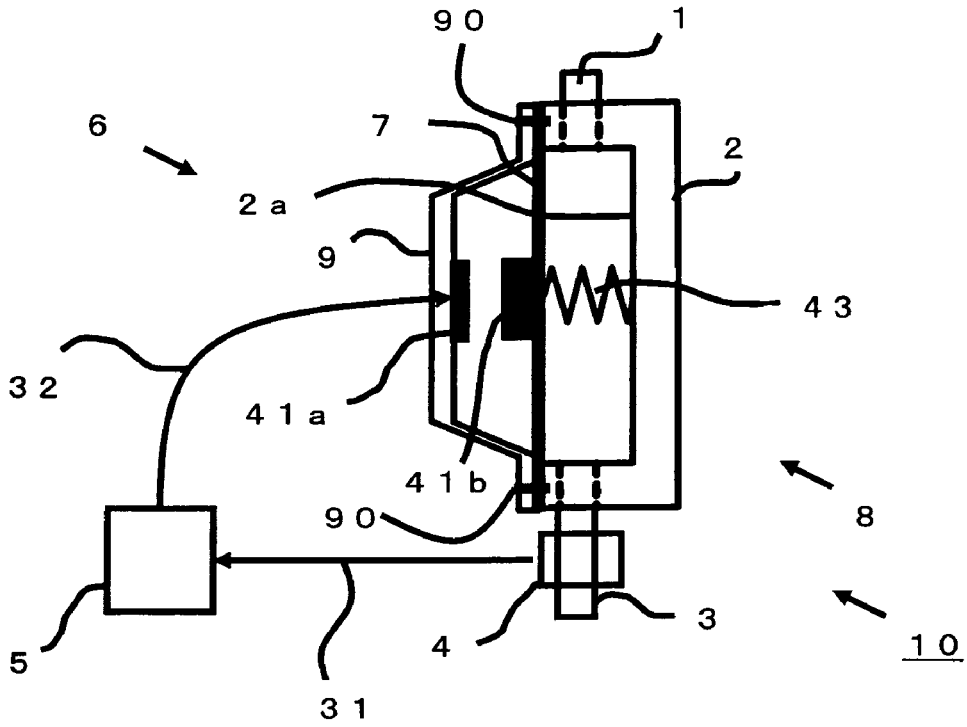
FIG. 6 is an explanatory diagram illustrating a specific structure of a pressure damper according to another embodiment of the present invention.

In this embodiment, as illustrated in FIG. 6, a coil portion engaged with the suppression plate 9 is the first coil portion 41*a*, and a coil portion engaged with the flexible film 7 is the second coil portion 41*b*. Further, each of the first coil portion 41*a* and the second coil portion 41*b* has a structure, in which an air core coil is fitted into a magnetic core which has a pot core structure and is E-shaped in cross section. The structure other than the first coil portion 41*a* and the second coil portion 41*b* is the same as that in the first embodiment (FIG. 4). In this structure, for example, a direct current is caused to continuously flow through the coil portion 41*b*, to thereby fix the magnetic poles. In this state, the coil portion 41*a* is driven by the drive signal 32 from the control circuit portion 5 as a current source. In this manner, it is possible to generate the attraction force and the repulsive force. Note that, in order to generate appropriate magnetic force to deform the flexible film 7, it is necessary to appropriately set a distance between the coils, magnitude of the current, and the number of coil turns.

Further, in the first embodiment, one of the two paired elements is the coil portion 41 and the other thereof is the magnetic body portion 42, but the present invention is not limited to this structure. For example, the magnetic body portion 42, which is the other of the two paired elements, may be a conductive member. In other words, the flexible film 7 may be deformed by an electromagnetic induction phenomenon, to thereby obtain the pressure damping action.

Further, in the first embodiment, there is described an example in which a low-density polyethylene film is used as the flexible film 7, and in addition, similarly, one of the two paired elements is the coil portion 41 and the other thereof is the magnetic body portion 42. However, the present invention is not limited to this structure. For example, the flexible film 7 may be formed of a magnetic member and a conductive member. In this case, the other of the two paired elements in the first embodiment is unnecessary, and thus the structure can be simplified.

Here, description is made of a location of the control circuit portion 5 in the above-mentioned first and second embodiments. The control circuit portion 5 may be disposed in the space generated between the flexible film 7 and the suppression plate 9. When adopting such a form, the pressure damper may be reduced in size.

(Modified Example)

In the first and second embodiments, description is made of a drive method using a coil and a magnetic member as the drive structure described above. As a modified example thereof, the pressure adjusting portion 6 may adopt a mechanical drive structure which is driven in accordance with the drive signal 32. That is, the pressure adjusting portion 6 is driven in synchronization with the drive signal 32 output from the control circuit portion 5, which is similar to the first and second embodiments. However, when the flexible film 7 is forcibly deformed, pressure may be mechanically applied to the flexible film 7.

(Liquid Jet Head)

Next, description is made of a liquid jet head mounting the pressure damper 10 according to another embodiment.

Figure 7:
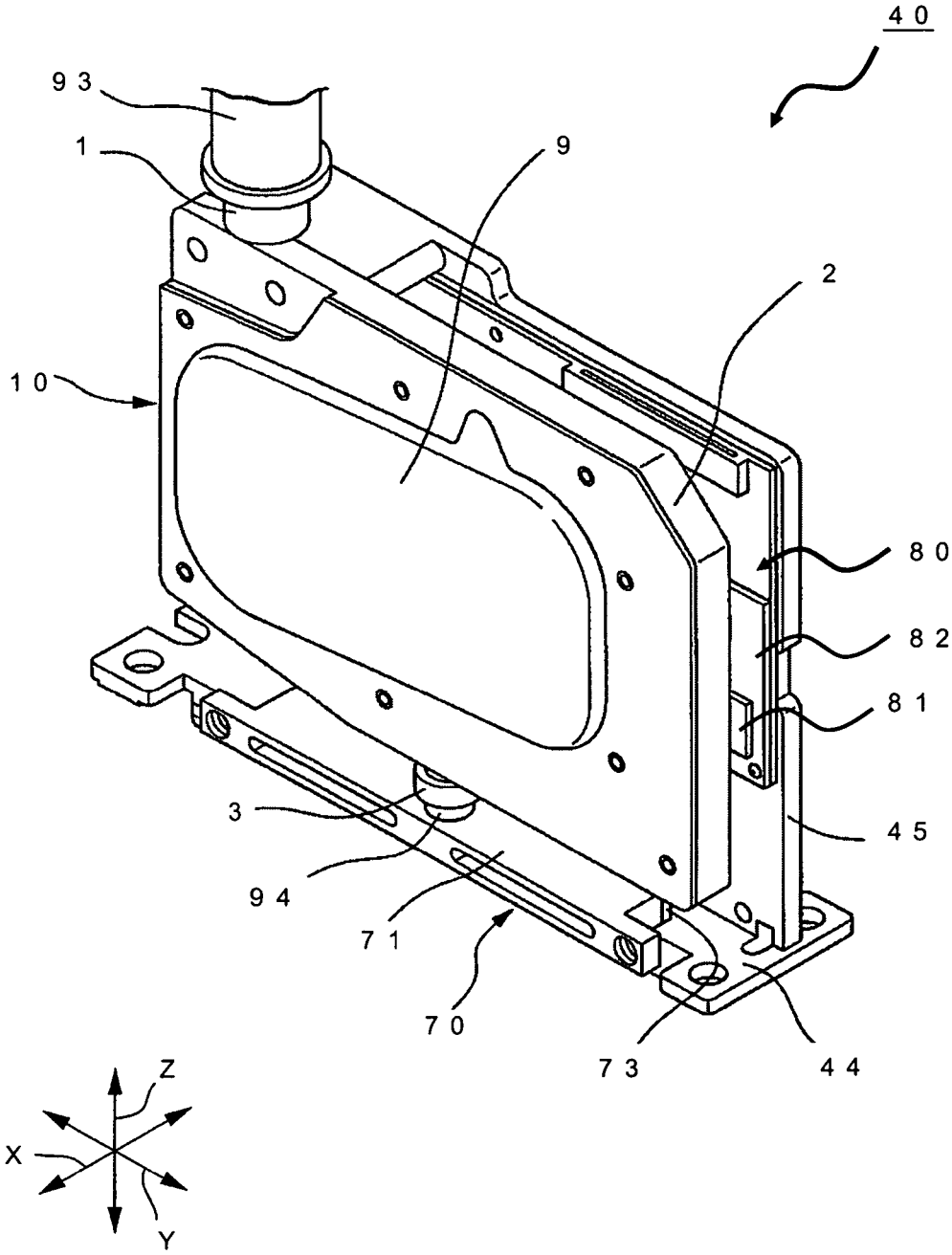
FIG. 7 is a perspective view of a liquid jet head according to further another embodiment of the present invention.

FIG. 7 is a perspective view of a liquid jet head 40. As illustrated in FIG. 7, the liquid jet head 40 includes, on base members 44 and 45, a jetting portion 70 for jetting liquid toward a recording medium s (see FIG. 8), and the pressure damper 10 interposed between the jetting portion 70 and the liquid inflow port 1, which allows liquid to flow from the liquid inflow port 1 to the jetting portion 70 while damping pressure fluctuation of the liquid. Note that, the base members 44 and 45 may be formed integrally.

A control circuit substrate 80 includes control means 81 for generating a drive pulse of an actuator 73 based on a signal such as pixel data from a main body control portion (see FIG. 8) of a liquid jet apparatus 100, and a sub-substrate 82 provided on the control circuit substrate 80.

The jetting portion 70 includes a flow path substrate 71 connected to the pressure damper 10 via the liquid outflow port 3, the actuator 73 including ceramic plates or the like arranged in the main scan direction, for jetting liquid as liquid droplets toward the recording medium s, and flexible wiring (not shown) electrically connected to the actuator 73 and the control circuit substrate 80, for transmitting the drive signal to a piezoelectric element of the actuator 73.

Further, the main body portion 2 is engaged with the base member 44. Further, there are formed a connector 93 which is attached to the liquid inflow port 1 in a detachable and watertight manner and a connector 94 of the jetting portion 70 which is attached to the liquid outflow port 3 in a detachable and watertight manner.

(Liquid Jet Apparatus)

Figure 8:
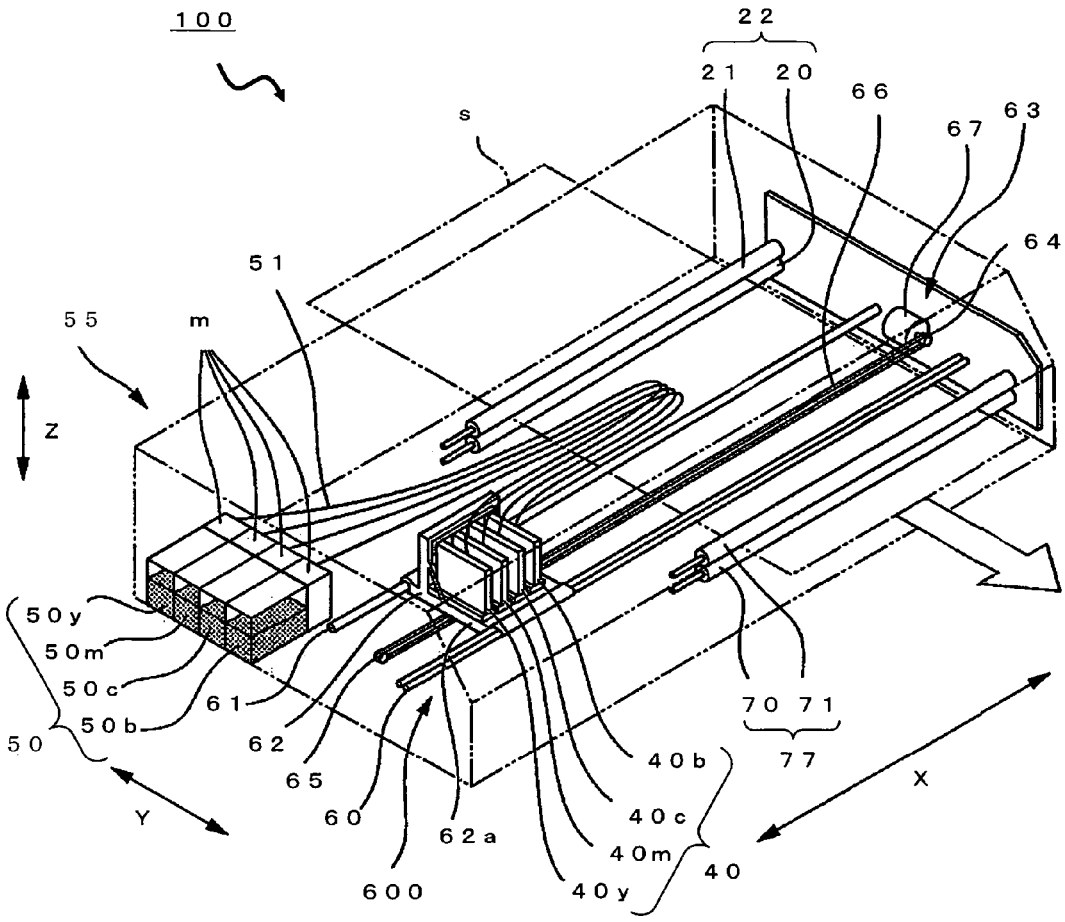
FIG. 8 is a perspective view of a liquid jet apparatus according to still another embodiment of the present invention.

FIG. 8 is a perspective view of the liquid jet apparatus. The liquid jet apparatus 100 includes a pair of transfer means 22 and 77 for transferring the recording mediums such as paper, the liquid jet head 40 for jetting liquid toward the recording medium s, liquid supply means 55 for supplying the liquid to the liquid jet head 40, and scan means 600 for causing the liquid jet head 40 to scan the recording medium s in a direction (sub scan direction) substantially orthogonal to a transfer direction (main scan direction) of the recording medium s. Hereinafter, description is made under the assumption that the sub scan direction is an X direction, the main scan direction is a Y direction, and a direction orthogonal to both of the X direction and the Y direction is a Z direction.

The pair of transfer means 22 and 77 include grid rollers 20 and 70 provided so as to extend in the sub scan direction, pinch rollers 21 and 71 extending in parallel with the grid rollers 20 and 70, respectively, and although not shown in detail, a drive mechanism, such as a motor, for rotating the grid rollers 20 and 70 around the axis.

The liquid supply means 55 includes a liquid container 50 for storing liquid, and the liquid inflow port 1 connecting the liquid container 50 and the liquid jet head 40. A plurality of the liquid containers 50 are provided. Specifically, liquid tanks 50*y*, 50*m*, 50*c*, and 50*b* storing four types of liquid of yellow, magenta, cyan, and black, respectively, are arranged. Each of the liquid tanks 50*y*, 50*m*, 50*c*, and 50*b* includes a pump motor m for causing liquid to move under pressure toward the corresponding liquid jet head 40 through the liquid inflow port 1. The liquid inflow port 1 includes a flexible hose 51 having flexibility, which is capable of responding to the movement of the liquid jet head 40 (carriage unit 62).

The scan means 600 includes a pair of guide rails 60 and 61 which are provided so as to extend in the sub scan direction, the carriage unit 62 which is slidable along the pair of guide rails 60 and 61, and a drive mechanism 63 for causing the carriage unit 62 to move in the sub scan direction. The drive mechanism 63 includes a pair of pulleys 64 and 65 provided between the pair of guide rails 60 and 61, an endless belt 66 wound around the pair of pulleys 64 and 65, and a drive motor 67 for rotary-driving one pulley 64.

The pulley 64 is disposed between one end portions of the pair of guide rails 60 and 61, and the pulley 65 is disposed between the other end portions of the pair of guide rails 60 and 61, and the pair of pulleys 64 and 65 are disposed with a gap provided therebetween in the sub scan direction. The endless belt 66 is disposed between the pair of guide rails 60 and 61. The carriage unit 62 is coupled to this endless belt 66. A plurality of the liquid jet heads 40 are mounted on a base end portion 62*a* of the carriage unit 62. Specifically, liquid jet heads 40*y*, 40*m*, 40*c*, and 40*b* corresponding to the four types of liquid of yellow, magenta, cyan, and black, respectively, are mounted on the carriage unit 62 while being arranged in the sub scan direction.

What is claimed is:

1. A pressure damper, comprising:

a main body portion including a recess portion for storing liquid;

a flexible film provided on the main body portion so as to cover the recess portion;

a liquid inflow port and a liquid outflow port which are communicated to the recess portion;

a pressure detecting portion for detecting a pressure value of the liquid flowing out from the liquid outflow port;

a control circuit for outputting a control signal based on the pressure value output from the pressure detecting portion; and a pressure adjusting portion for adjusting the pressure of the liquid in the recess portion by forcibly deforming the flexible film based on the control signal output from the control circuit.

2. A pressure damper according to claim 1, wherein the pressure adjusting portion comprises two paired elements which are controllable based on the control signal to generate therebetween an attractive force or a repulsive force depending on the control signal, one of the two paired elements being engaged with the flexible film.

3. A pressure damper according to claim 2, further comprising a suppression plate which is engaged with the main body portion and covers the flexible film.

4. A pressure damper according to claim 3, wherein the other of the two paired elements is engaged with the suppression plate.

5. A pressure damper according to claim 4, wherein the one element engages with a surface of the flexible film and the other element engages with surface of the suppression plate on the flexible film side so that the two paired elements are opposed to each other.

6. A pressure damper according to of claim 3, wherein the control circuit is disposed between the flexible film and the suppression plate.

7. A pressure damper according to claim 2, wherein one of the two paired elements comprises a coil portion, and the other of the two paired elements comprises a magnetic body portion.

8. A pressure damper according to claim 2, wherein one of the two paired elements comprises a first coil portion, and the other of the two paired elements comprises a second coil portion.

9. A pressure damper according to claim 1, further comprising a bias member which is elastically deformable and which is disposed between the recess portion and the flexible film.

10. A liquid jet head, comprising:

the pressure damper according to claim 1; and a plurality of nozzles for jetting liquid supplied from the liquid outflow port.

11. A liquid jet apparatus, comprising:

the liquid jet head according to claim 10;

a moving mechanism for reciprocating the liquid jet head in a manner that the liquid jet head is opposed to a recording medium; and a transfer mechanism for transferring the recording medium past the liquid jet head.

12. A pressure damping method for a pressure damper that has a main body portion including a recess portion for storing liquid, a flexible film provided on the main body portion so as to cover the recess portion, and a liquid inflow port and a liquid outflow port which communicate with the recess portion, the pressure damping method comprising:

detecting a pressure value of the liquid flowing out from the liquid outflow port and outputting the pressure value to a control circuit; and adjusting the pressure of the liquid in the recess portion by forcibly deforming the flexible film based on a control signal output from the control circuit based on the pressure value.

* * * * *